US007552681B1

(12) United States Patent
Laib et al.

(10) Patent No.: US 7,552,681 B1
(45) Date of Patent: Jun. 30, 2009

(54) MEMS FUZE ASSEMBLY

(75) Inventors: Gerald Laib, Olney, MD (US); David Olson, Chesapeake Beach, MD (US); Daniel Jean, Odenton, MD (US); John Hendershot, Dunkirk, MD (US); Lawrence Fan, Vienna, VA (US); Michael Beggans, Waldorf, MD (US); Ezra Chen, Potomac, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/894,628

(22) Filed: Jul. 31, 2007

(51) Int. Cl.
*F42C 15/34* (2006.01)

(52) U.S. Cl. ..... 102/254; 102/233; 102/249; 102/251

(58) Field of Classification Search ..... 102/233, 102/249, 251, 254
See application file for complete search history.

(56) References Cited

U.S. PATENT DOCUMENTS

| | | | | |
|---|---|---|---|---|
| 6,314,887 | B1 * | 11/2001 | Robinson | 102/262 |
| 6,321,654 | B1 * | 11/2001 | Robinson | 102/251 |
| 6,568,329 | B1 | 5/2003 | Robinson | |
| 6,675,578 | B1 | 1/2004 | Sinclair | |
| 6,737,979 | B1 | 5/2004 | Smith et al. | |
| 6,964,231 | B1 * | 11/2005 | Robinson et al. | 102/235 |
| 7,007,606 | B1 * | 3/2006 | Maurer et al. | 102/226 |
| 7,069,861 | B1 * | 7/2006 | Robinson et al. | 102/222 |
| 7,316,186 | B1 * | 1/2008 | Robinson et al. | 102/251 |

* cited by examiner

*Primary Examiner*—Michael Carone
*Assistant Examiner*—Samir Abdosh
(74) *Attorney, Agent, or Firm*—Fredric J. Zimmerman

(57) ABSTRACT

A MEMS fuze having a moveable slider with a microdetonator at an end for positioning adjacent an initiator. A setback activated lock and a spin activated lock prevent movement of the slider until respective axial and centrifugal acceleration levels have been achieved. Once these acceleration levels are achieved, the slider is moved by a V-beam shaped actuator arrangement to position the microdetonator relative to a secondary lead to start an explosive train in a munitions round.

9 Claims, 4 Drawing Sheets

MEMS FUZE ASSEMBLY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1) Field of the Invention

The invention relates in general relates to MEMS (microelectromechanical systems) devices and more particularly to a MEMS fuze utilized to set off a main charge of a munitions round.

2) Description of the Related Art

A fuze is a device designed to set off an explosive train in a munitions round such as a mortar round, artillery shell or rocket warhead, by way of example. Conventional mechanical fuzes make use of a detonator, such as an M100, which is cylindrical and approximately 3 mm (millimeters) in diameter and 10 mm in length. These detonators are mounted in a rotor mechanism with mechanical locks, with a typical volume of greater than 10 cc (cubic centimeters).

Such detonators are much too large for use in MEMS type fuzes and, in addition, they require assembly of multiple mechanical components resulting in higher complexity, higher costs and lower reliability.

SUMMARY OF THE INVENTION

It is an object of the present invention to provide a fuze assembly that is over 100 times smaller than conventional detonators, thus leaving more space for electronics and explosive material.

A MEMS fuze for use in a munitions round in accordance with the present invention includes a moveable slider with a microdetonator carried by the slider for positioning relative to a secondary lead to ignite the secondary lead when in position. A plurality of locks are provided, each having a respective locking arm in interlocking engagement with the slider to prevent movement of the slider. The locks are released upon attainment of certain predetermined conditions to move the locking arms out of engagement with the slider whereby when the locking arms are disengaged from the slider, the slider is operable to move the microdetonator into position for igniting the secondary lead.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Figure 1A:
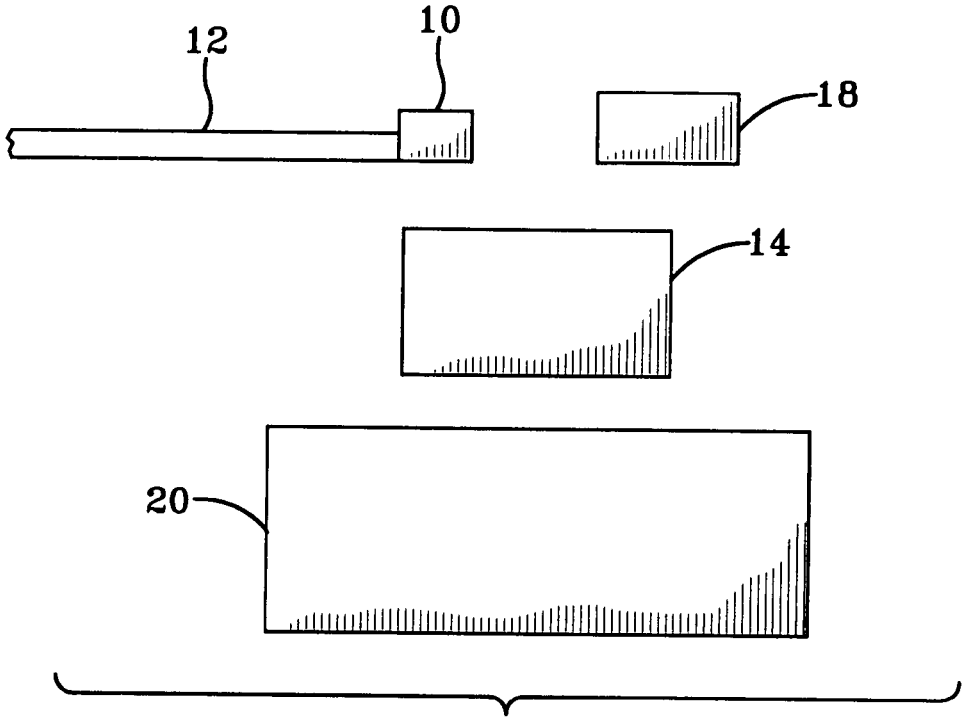
FIGS. 1A and 1B illustrate an operation of an exemplary microdetonator.
Figure 1B:
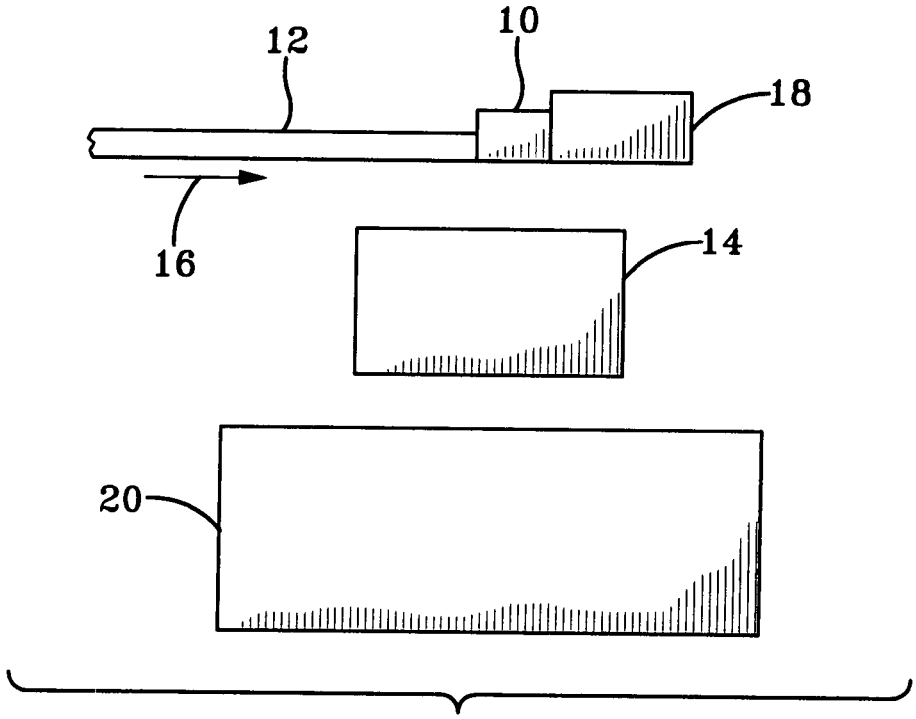

FIGS. 1A and 1B illustrate a microdetonator and its placement for initiating a charge sequence. In FIG. 1A, a microdetonator 10 is carried by a slider 12 and is in an initial position insufficient to set off a secondary explosive 14, also known as a secondary lead.

When the slider 12 moves to the right as indicated in FIG. 1B by arrow 16, microdetonator 10 may be adjacent an initiator 18 and directly above secondary lead 14, whereupon the microdetonator 10 may be initiated or detonated by the initiator 18. Secondary lead 14 may be initiated by the microdetonator 10 and set off a main explosive charge 20, which is the main charge of the munitions round in which the apparatus is imbedded. Movement of slider 12 may be inertial, such as upon impact with a target, or may be mechanical, as will be described herein.

Figure 2:
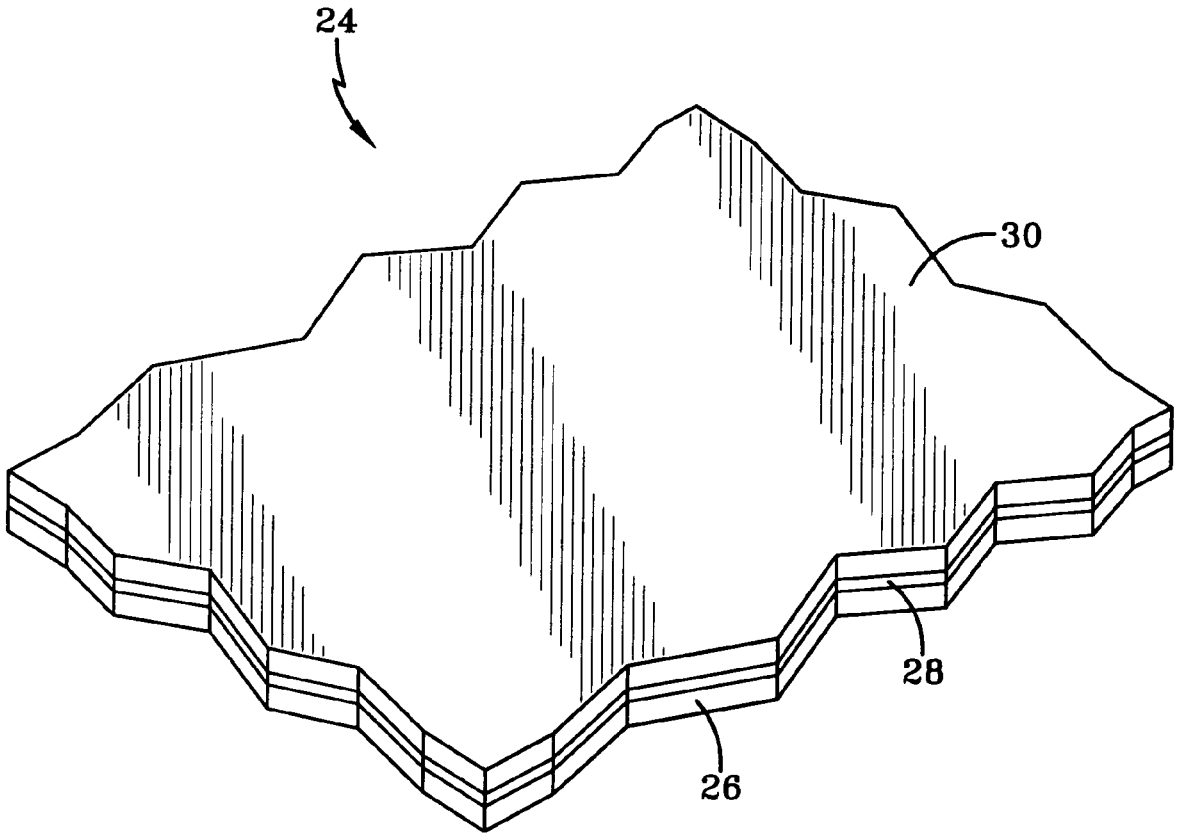
FIG. 2 illustrates an exemplary SOI (silicon on insulator) wafer prior to fabrication of the MEMS device of the present invention.

FIG. 2 illustrates a portion of an SOI wafer 24 from which the MEMS fuze assembly of the present invention is fabricated. The structure of FIG. 2 includes, in an exemplary embodiment, a silicon substrate 26 (also known as a handle layer) covered by an insulating or intermediate layer 28, such as silicon dioxide, over which is bonded or deposited another silicon layer 30, also known as the device layer 30, which is the layer from which the MEMS fuze assembly components are fabricated. The MEMS fuze assembly components may be formed by a DRIE (deep reactive ion etching) process that removes unwanted portions of device layer 30. The DRIE process is a well developed micromachining process used extensively with silicon based MEMS devices. For this reason silicon is an exemplary material for the MEMS fuze assembly of the present invention, although other materials are possible. In other exemplary embodiments, materials other than silicon may be used as a substrate, including glass, stainless steel, and a plastic material, such as, polycarbonate.

Figure 3A:
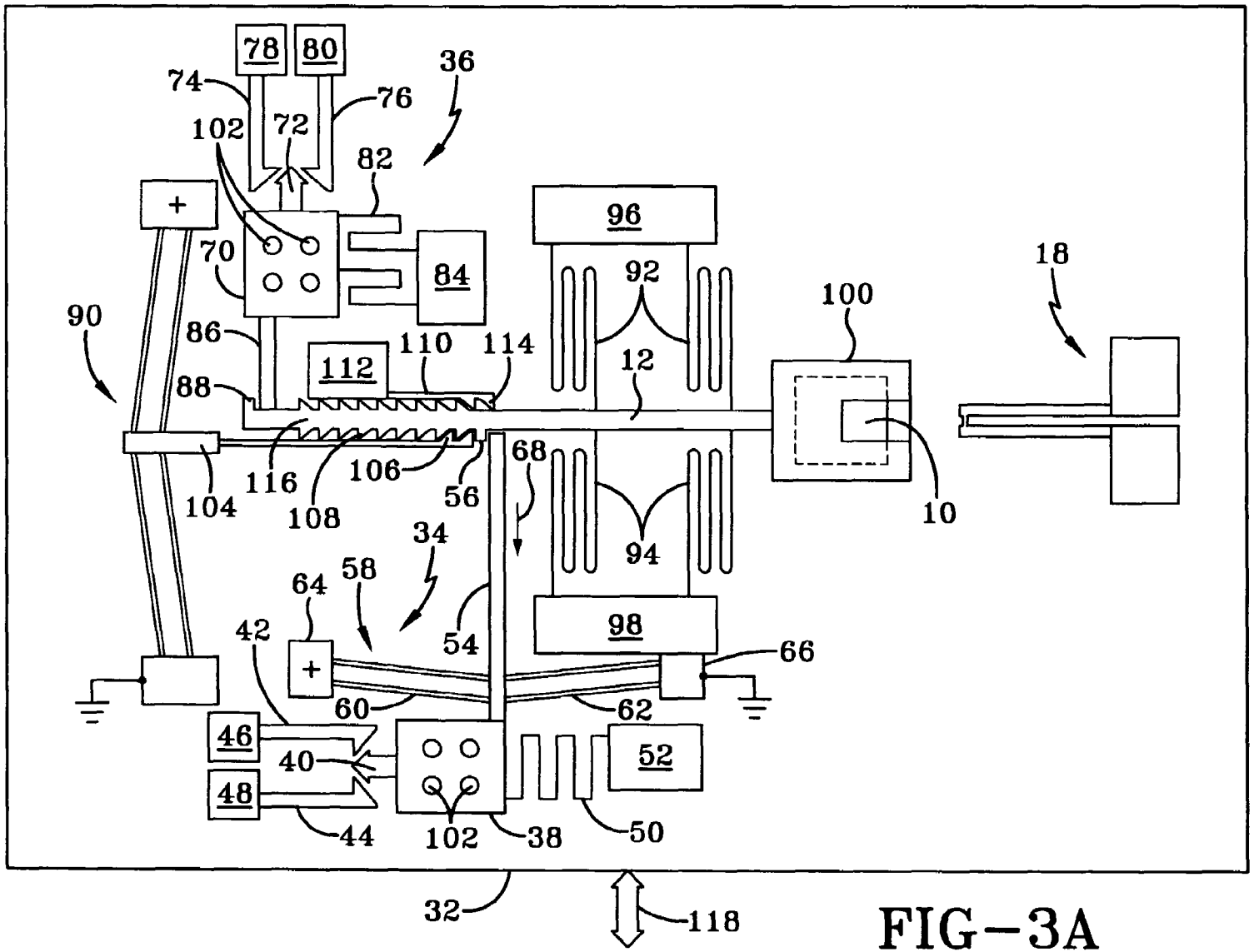
FIGS. 3A and 3B illustrate an exemplary embodiment of the present invention.
Figure 3B:
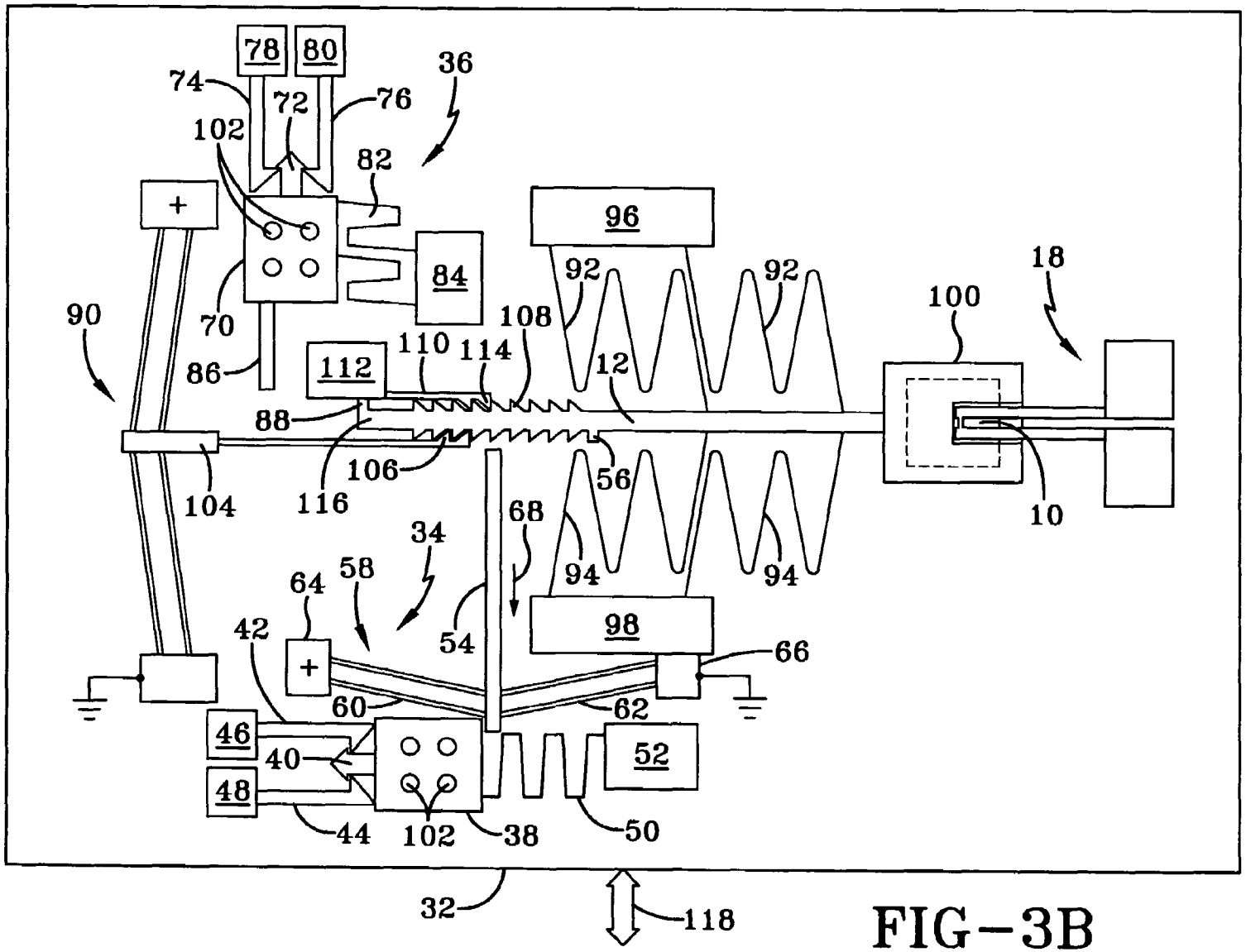

An exemplary embodiment of the present invention is illustrated in FIGS. 3A and 3B. The MEMS fuze 32 in FIG. 3A includes slider 12 which, in an exemplary embodiment, is driven mechanically as opposed to inertially. As a safety precaution and in accordance with safety regulations, movement of the slider 12 is initially prevented by a series of locks, which are released upon attainment of certain predetermined conditions. Slider 12 is in the safe position in FIG. 3A and in the armed position in FIG. 3B. By way of example, the arrangement includes a setback activated lock 34 and a spin activated lock 36.

Setback activated lock 34 includes a setback inertial mass 38 having a latching arm 40 that engages with complementary first and second holding arms 42 and 44, these latter first and second holding arms may be connected to respective anchors 46 and 48. Setback inertial mass 38 is restrained from movement by spring 50 connected to anchor 52. Setback activated lock 34 additionally includes a locking arm 54, which is in interlocking relationship with slider 12. More particularly, the end of locking arm 54 abuts a projection 56 on slider 12 to prevent movement thereof.

Setback inertial mass 38 prevents movement of locking arm 54 until setback inertial mass 38 is moved out of the way. This movement occurs during launch of the munitions round when the axial acceleration force allows setback inertial mass 38 to overcome action of spring 50 such that latching arm 40 may become latched with holding arms 42 and 44. With setback inertial mass 38 out of the way, locking arm 54 is free to disengage from projection 56 of slider 12.

The disengagement is accomplished with the provision of a thermoelectric actuator such as V-beam actuator 58. V-beam actuator 58 includes first and second sets of actuator beams 60 and 62. One end of set 60 is connected to anchor 64, while the other end is connected to locking arm 54. One end of set 62 is connected to a second anchor 66, with the other end connected to locking arm 54. The first and second set of beams 60 and 62 are of a conductive elastic material with a high melting point, such as silicon. When a current is applied to anchor 64, the beams 60, 62 expand, causing the locking arm 54 to move in the direction of arrow 68. This current may be applied prior to unlocking of spin activated lock 36 or subsequent thereto.

Spin activated lock 36 includes a spin inertial mass 70 having a latching arm 72 which engages with complementary third and fourth holding arms 74 and 76, these latter third and fourth holding arms may be connected to respective anchors 78 and 80. Spin inertial mass 70 is restrained from movement by spring 82 connected to anchor 84. Spin activated lock 36 additionally includes a locking arm 86, connected to spin inertial mass 70, with the locking arm 86 in interlocking relationship with slider 12. More particularly, the end of locking arm 86 abuts a projection 88 on slider 12 to prevent movement thereof. A sufficiently high centrifugal acceleration allows spin inertial mass 70 to overcome action of spring 82 such that latching arm 72 becomes latched, drawing locking arm 86 out of engagement with projection 88 to allow slider 12 to move.

A thermoelectric actuator in the form of V-beam actuator 90, similar to V-beam actuator 58, is used to move the slider 12 against action of springs 92 and 94, connected to respective anchors 96 and 98. Slider 12 includes an enlarged end portion 100 in which is located the microdetonator 10.

To operate as a MEMS fuze, the various springs, locking arms and beam sets of the V-beam actuators must be free to move and therefore must be free of any underlying silicon dioxide insulating layer 28 (FIG. 2). One way to accomplish the removal of the underlying insulating layer is by applying an etchant, such as, hydrofluoric acid, which will dissolve the silicon dioxide. The etchant may, in a relatively short period of time, dissolve the insulation beneath the locking arms and the beam sets of the V-beam actuators, as well as the springs and slider because these components have small widths. The setback inertial mass 38 and spin inertial mass 70 must be free to move and therefore must be free of any underlying silicon dioxide insulating layer 28 (FIG. 2).

To shorten the time for dissolving the silicon dioxide under these relatively larger components (masses 38, 70), each is provided with a series of apertures 102, which extend from the top surface 30 down to the insulating layer 28, thereby allowing the etchant direct access to the silicon substrate 26. Although some of the etchant may dissolve the insulation under the anchors, the process of freeing the other components is generally completed before the anchors are completely freed so that they, that is, the anchors, remain immovable.

An actuator arm 104 of V-beam actuator 90 carries one or more teeth 106 at its end which are engageble with teeth 108 on the bottom of slider 12. When V-beam actuator 90 is provided with current, actuator arm 104 moves to the left, and teeth 106 on actuator arm 104 slide over teeth 108 on slider 12. When current is removed, V-beam actuator 90 reverts to its original position such that actuator arm 104 will move back to the right. In so doing, teeth 106 engage with teeth 108 to move the slider 12 to the right.

A keeper arrangement prevents the slider 12 from moving back under spring action once the slider 12 has been advanced. Such a keeper arrangement includes a keeper arm 110 secured to anchor 112. Keeper arm 110 includes a set of teeth 114, which are engageable with teeth 116 on the top of slider 12. After slider 12 is advanced, teeth 114 engage teeth 116 to prevent backward movement of slider 12.

The process of providing current to, and removing current from, V-beam actuator 90 is repeated until slider 12 has moved a sufficient distance such that microdetonator 10 is adjacent initiator 18, as illustrated in FIG. 3B. When in position, and at the proper time, current may be supplied to initiator 18 to initiate microdetonator 10 and start the explosive train.

Current is supplied to initiator 18, as well as to V-beam actuators 58 and 90 by means of current sources (not illustrated) via electrical connections depicted by double ended arrow 118. A microprocessor (not illustrated) is operable to receive signals via electrical connections when latching arms 40 and 72 latch, and when microdetonator 10 is in position, to command the current sources to provide the respective currents used in the operation.

It will be understood that many additional changes in the details, materials, steps and arrangement of parts, which have been herein described and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A MEMS fuze assembly for use in a munitions round, comprising:

a moveable slider;

a microdetonator being carried by said moveable slider for positioning relative to a secondary lead for igniting said secondary lead when in an armed position;

a setback activated lock comprising a setback locking arm in an interlocking relationship with said moveable slider and said setback locking arm being maintained in position by said setback activated lock for preventing movement of said moveable slider;

a spin activated lock comprising a spin locking arm in interlocking relationship with said moveable slider where said spin locking arm is maintained in position by said spin activated lock to prevent movement of said moveable slider; and a thermoelectric actuator being coupled to said moveable slider for moving said moveable slider, wherein said setback activated lock is operable to allow disengagement of said setback locking arm from said moveable slider when said munitions round has attained a certain axial acceleration, wherein said spin activated lock is operable to allow disengagement of said spin locking arm from said moveable slider when said munitions round has attained a certain centrifugal acceleration, and wherein said setback locking arm and said spin locking arm are disengaged from said moveable slider so that said moveable slider is operable to move said microdetonator into said armed position to ignite said secondary lead.

2. The assembly according to claim 1, wherein said thermoelectric actuator is a V-beam shaped actuator.

3. The assembly according to claim 1, wherein said thermoelectric actuator is coupled to said setback locking arm to move said setback locking arm.

4. The assembly according to claim 1, wherein said thermoelectric actuator is a V-beam shaped actuator.

5. The assembly according to claim 1, wherein said setback activated lock comprises a setback inertial mass including a latching arm latchable with first and second holding arms and an anchored spring connected to said setback inertial mass, and wherein said certain axial acceleration is attained so that said latching arm latches with said first and second holding arms to maintain said setback inertial mass in position against action of said anchored spring and allow movement of said setback locking arm.

6. The assembly according to claim 1, wherein said spin activated lock comprises a spin inertial mass including a latching arm latchable with third and fourth holding arms, and an anchored spring connected to said spin inertial mass, and wherein said certain centrifugal acceleration is attained so that said latching arm latches with said third and fourth holding arms to maintain said spin inertial mass in position against action of said anchored spring.

7. The assembly according to claim 1, wherein said setback locking arm is disengaged from said moveable slider before said spin locking arm is disengaged from said slider.

8. The assembly according to claim 1, wherein said interlocking relationship between said setback locking arm and said moveable slider includes a projection on said moveable slider in which said projection abuts an end of said setback locking arm.

9. The assembly according to claim 1, wherein said interlocking relationship between said spin locking arm and said moveable slider includes a projection on said moveable slider in which said projection abuts an end of said spin locking arm.

* * * * *